United States Patent [19]

Hoppen et al.

[11] 4,113,187

[45] Sep. 12, 1978

[54] METHOD AND APPARATUS FOR DRYING AND GRINDING

[75] Inventors: Heinz Hoppen, Overath-Steinenbrück; Heinz Fasbender, Krefeld, both of Germany

[73] Assignee: Klöckner-Humboldt-Deutz Aktiengesellschaft, Germany

[21] Appl. No.: 787,598

[22] Filed: Apr. 14, 1977

[30] Foreign Application Priority Data

May 8, 1976 [DE] Fed. Rep. of Germany ..... 2620461

[51] Int. Cl.[2] ..... B02C 23/12

[52] U.S. Cl. ..... 241/24; 241/29; 241/78; 241/80

[58] Field of Search ..... 241/18, 24, 29, 30, 241/76, 77, 78, 80

[56] References Cited

U.S. PATENT DOCUMENTS

| | | | |
|---|---|---|---|
| 3,397,845 | 8/1968 | Muller | 241/78 |
| 3,402,895 | 9/1968 | Willmann | 241/80 |
| 3,529,778 | 9/1970 | Willmann | 241/24 |
| 3,982,699 | 9/1976 | Jager | 241/80 |

*Primary Examiner*—Granville Y. Custer, Jr.
*Attorney, Agent, or Firm*—Hill, Gross, Simpson, Van Santen, Steadman, Chiara & Simpson

[57] ABSTRACT

A drying-grinding apparatus including two types of grinding means, one being arranged to produce a relatively coarse ground product, and the other being arranged to produce a relatively finely ground product. A drying gas is introduced into each of the grinding means, and a common conduit delivers the ground products from both of the two grinding means into a sifting means. The sifting means discharges relatively coarse particles into a metering means which receives the output from the sifting means and separates the same into two fractions one of which is returned to the coarse grinding means, and the other of which goes to the fine grinding means.

8 Claims, 7 Drawing Figures

METHOD AND APPARATUS FOR DRYING AND GRINDING

BACKGROUND OF THE INVENTION

1. Field of the Invention

This invention is in the field of a method and apparatus for drying and grinding particulate material, including a pair of grinding means, one being of the type which produces a relatively coarse product and the other producing a relatively fine product. A common conduit directs the ground products from both the grinding means into a sifting means, and the fraction recovered by sifting is then passed to a metering means which selectively passes controlled quantity fractions back into either the coarse grinding or the fine grinding means.

2. Description of the Prior Art

In prior art grinding-drying installations, it is known to provide, for example, a hammer mill in combination with a riser or uptake through which heating gas flows to an air current or air swept separator or sifter. The latter removes the gravel which is then passed for subsequent comminution to the desired final fineness in a second comminution step. As an example of such a prior art system, we refer to German Pat. No. 1,439,835 which shows a grinding-drying installation with a feed pipe or uptake through which the heating gas flows, and utilizes two different types of mills which are attached laterally to the pipe at their discharge ends.

In this known grinding-drying installation there is the feature that the inlets of both mills are in selectively connectible connection through a branch point in the discharge pipe of the gravel coming from the sifter in such a way that the grinding may be carried out to completion either in one or the other mill. A special embodiment of a coal grinding installation using a tube mill and a hammer mill is disclosed, for example, in German Pat. No. 698,311. This type of installation uses a rotatable valve at a crossing point of the conduits coming from the raw material charger and the sifter with the conduits going onto the hammer mill and to a tube mill. In this way, the raw material may be conducted to the tube mill and the gravel to the hammer mill or the raw material and the gravel together may be directed to the tube mill or they may be directed together to the hammer mill.

Various known grinding-drying installations have used pre-comminution devices such as hammer mills which knock the material to be comminuted through a grate. The material falling out of the grate is conveyed through a riser or uptake to a sifter in which a separation takes place into finished material and material which is comminuted further. Such an arrangement is satisfactory where the material is very conducive to comminution, and there are no special requirements present as to the fineness of the grains and the uniformity of the final material.

The present invention is particularly directed to a special application of the drying-grinding technique wherein a starting material with a relatively high moisture content must be ground in a uniform manner to provide a fineness which provides as large a reaction surface as possible. In addition to the improved grinding result, the economy of the grinding-drying process must be satisfactory.

SUMMARY OF THE INVENTION

The method and apparatus of the present invention are particularly applicable to the situation of grinding an ore or a roasting charge for a subsequent wet metallurgical process. In the manufacture of cement, for example, utilizing clinker burning, a pulverized coal firing is used in which the requirement for attaining a complete burning of the flames within a predetermined zone of the combustion chamber requires that the grinding fineness of the coal dust be more critically observed than, for example, when firing a boiler.

In the case of grinding coal for a rotary kiln firing, very high demands are put on the grinding installation. In the case of coal dust firings, it is necessary to grind the coal dust so fine that as great a reaction surface as possible is provided, without running into excessive investment costs, energy requirements, and wear. In the case of a grinding of coal dust which is too coarse, the danger exists that the unburned part of the coal dust becomes excessive. In the case of too fine grinding, the energy requirements and the wear increase uneconomically.

The fineness required for good combustion in coal dust is determined with a minimum of uncombustible material through the gas content of the combustibles. The following values for various fuels are typical:

Anthracite coals about 5–7%,
Bituminous coals about 15–18%,
Gas flame coals about 30–35%,
Lignites about 40–60%, The requisite fineness of coal dust with the necessary reaction surface can be produced, for example, for boiler firings with different types of mills such as tube mills, spring biased and centrifugal mills, as well as pugmills or beatermills.

In the case of coal dust fired rotary kilns as used, for example, for the calcining of clinkers, the attainment of a complete burning of the coal within the sintering zone necessitates the substantially higher requirements be put on the grinding fineness of the coal dust. Therefore, the coal dust in the case of such calcining processes is ground appreciably finer. Typically, coal dust for this purpose is produced in tube mills as well as spring-biased or centrifugal force mills exclusively. Pugmills or beatermills are not used for this purpose because the coal dust which is produced in these mills does not have the required large reaction surface. Thus, for example, a coal dust from a tube mill has a surface of about 8200 square centimeters per cubic centimeter, whereas a coal dust produced by a pugmill or beatermill has a surface of only about 3500 square centimeters per cubic centimeter. In addition, pugmills are limited in their dimensions and also accordingly in their output. On the other hand, it is known that the grinding of coal in rapidly running pugmills is probably more economical than in gravity mills and in general also more economical than in spring-biased or centrifugal force mills. Consequently, in coal power plants pugmills are frequently used as injection mills.

For this purpose, different types of pugmills are known which partially operate as self-operating ventilator mills, and partially are equipped with separate blowers. A disadvantage of these mills is that they are uneconomical upon increasing specific grinding resistance of the coal because of the high degree of wear which occurs. The use of these mills, therefore, is most advantageous for the grinding-drying of lignite as well as for pit or mineral coal with low or average grinding resistance.

Tube mills are known which operate as injector mills for coal dust which because of their inertia cannot satisfy the rapid changes in the coal dust requirements because the duration of the coals in the grinding system is too long. In addition, tube mills under partial load operation operate very uneconomically as the idling energy requirement amounts to about 85 to 88%. In the case of partial load operation, the low amount of grinding material in the mill increases wear on the steel plate lining and on the balls. In addition to this there is the danger of breaking the armor plates. An earlier suggested momentary alteration of the fineness of the coal dust by regulation of the sifter and a momentary alteration occasioned thereby of the quantity of coal dust for injection into a boiler is not utilizable with the sensitivity of flame required in a rotary kiln furnace.

In the case where the coal dust fired rotary kilns are driven with injector mills, spring-biased or centrifugal force mills are indicated for the purpose.

The essential requirements which have to be met for a coal dust injection mill operating in conjunction with a rotary kiln are:

(a) Production of a coal dust with a large reaction surface.

(b) Rapid and fargoing applicability to the changeable dust requirements of the rotary kiln.

(c) Uniform coal dust fineness regardless of output.

The present invention provides an economical solution which takes advantages of the advantageous features of a tube mill and of a pugmill such that the grinding system is optimized and is operated in the ordinary manner as an injector mill.

In tests made of dry grinding installations of the type described herein, it was determined that the time for the passage of the grinding material from delivery into the grinding system through the sifter outlet amounts to only about 8 to 15 seconds. On the contrary, the time which is required for grinding material through a conventional breaker hammer mill without even producing the necessary dust fineness amounts to 5 to 8 minutes before it is discharged from the cyclone separator.

In a preferred form of the present invention, an impact pulverizer or hammer mill is provided with a closed floor and operates as a comminution mill. A tube mill is employed as a pulverizer utilizing air currents or air sweeping. An air current sifter discharges gravel into a metering device which divides the quantity of gravel into partial quantities and supplies it selectively to each of the two mills. The gravel return may include a device which is arranged to divide the quantity of gravel dependent upon the quantity and/or quality of the fractions which it contains.

The quantity of finished material which is contained in the stream of material issuing from the coarse grinding mill is dependent on the grindability of the material, the amount of finished material already contained in the charging material, and on the circumferential speed of the rotor of the hammer mill. Without the partial return according to the present invention of gravels in the hammer mill, this quantity of finished material may amount to approximately 50% of the total output. If, however, the gravel in the grinding system of this invention is conveyed up to half into the hammer mill and into the tube mill, then the tube mill needs only to handle 25% of the total output. This can be attained according to the present invention by providing a device for dividing gravel which includes a volumetrically metering divider such as a metering worm feed or a metering bucket wheel charging valve. The metering device may also consist of a rocker device, for example, a rocking container or a conveyor type weigher. Still another metering device which can be used for the present invention is a classifer such as a sieve machine or a coarsely classifying dynamic sifter.

With a device according to the present invention, in contrast to the prior art devices, it is possible to classify the gravel according to grain size before its return into the individual grinding aggregates of the dry grinding installation so that the coarser gravel may be conveyed back into the pre-comminution mill while the finer gravel is supplied to the pulverizer.

For providing an optimal drying output, each of the two mills may further be provided with an independently adjustable regulating member for the drying gas supply being fed to each mill.

Particular advantages result when using the dry grinding installation according to the present invention in the dry grinding of coal, particularly with subsequent direct injection of the coal dust produced into a combustion chamber.

In one of the preferred embodiments of the present invention, the method of dry grinding involves regulating the quantity of gravel conveyed back into the pre-comminution mill in response to the current input to the motor of this mill. In this way, the pre-comminution mill is used at its best potential without the mill and its operating or driving members being dangerously overloaded.

Another advantageous method for the operation of the dry grinding installation according to the invention involves regulating the quantity of gravel conveyed back into the tube mill in response to the filled condition of the mill. This is an important feature providing economy for the entire grinding installation, as the filling condition of the tube mill is adjustable independently of the output, and the tube mill is run at or near capacity, thereby protecting the mill against excessive wear.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
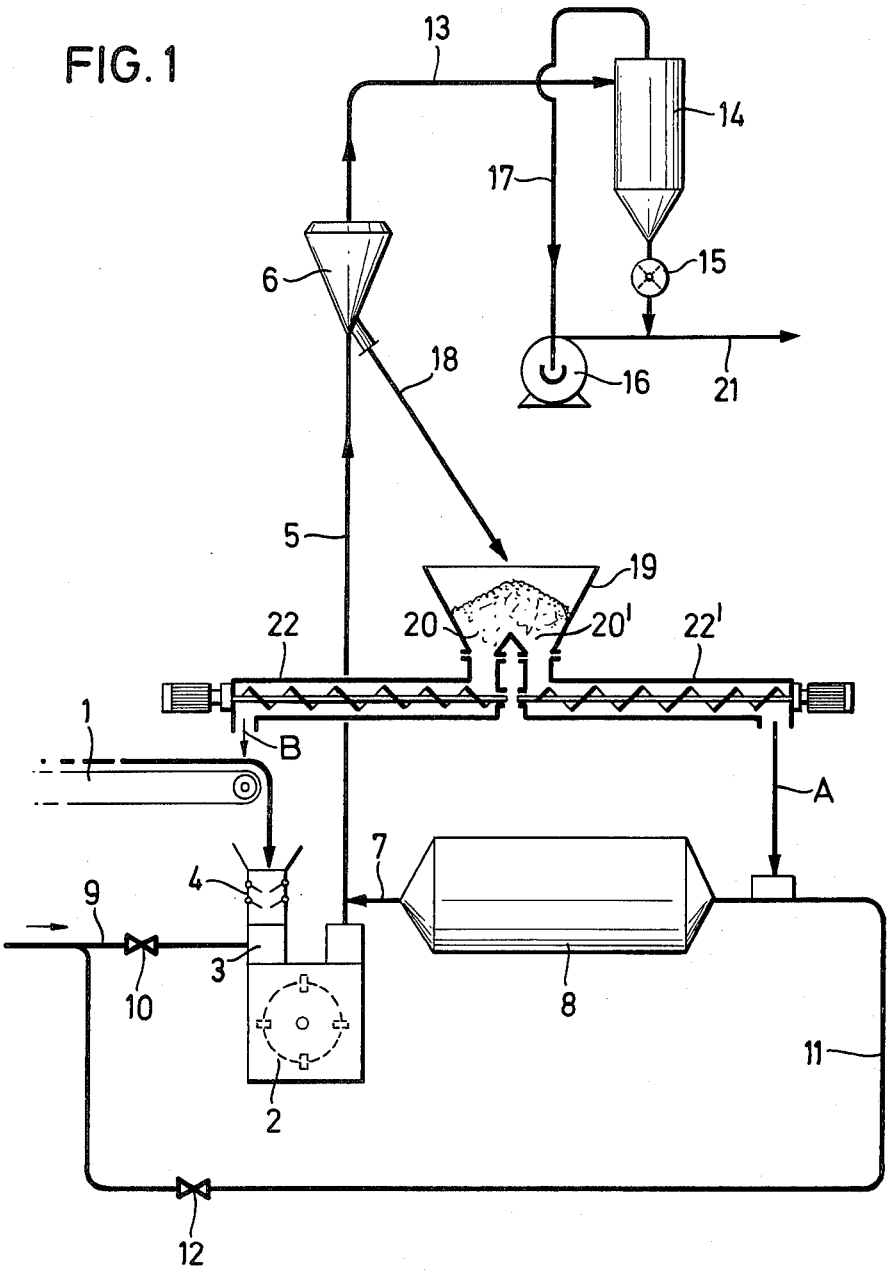
FIG. 1 is a somewhat schematic flow diagram of a dry grinding installation employing the improvements of the present invention.

In FIG. 1, the raw material is shown being supplied by means of a conveyor belt 1 to a breaker-hammer mill 2 having a closed floor. The material passes through a double oscillating charging valve 4 positioned in a charging shaft 3 of a breaker-hammer mill 2. After precomminution, the material is supplied into a riser conduit 5 and then into a sifter 6. The conduit 5 likewise receives the discharge from a discharge tube 7 connected to a tube mill 8. A drying gas is fed by means of a conduit 9 controlled by a valve 10 to fill the breaker-hammer mill 2 with the drying gas in an adjustable quantity. A branch conduit 11 supplies additional amounts of drying gas through a valve 12 into the tube mill 8. The streams of drying gas laden with comminuted material from both mills jointly pass up the common conduit 5 into the sifter 6 which divides the mixture into finished material and gravel.

The finished coal dust is transported through a conduit 13 to a cyclone separator 14 where it is precipitated and discharged through an air shut-off valve 15 while the stream of conveyor gas freed from dust is drawn up through a pipe 17 by means of a mill and injection ventilator 16 and is supplied through a conduit 21 together with the coal dust to a burner (not shown).

Figure 2:
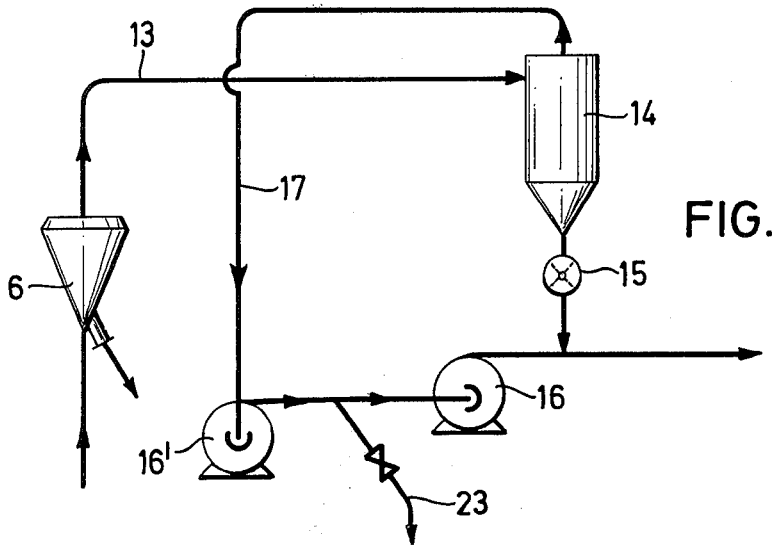
FIG. 2 is a partial flow diagram of a modified system used according to the present invention.

When the quantity of gas used to circulate the material is too large to serve as a primary air source for the furnace operation, then a system according to FIG. 2 can be used wherein a part of the air circulating in the mill is conveyed back through a pipe conduit 23 into the grinding system. Specifically, the air can be recirculated selectively into the drying gas conduit 9 leading to the breaker-hammer mill 2 or into the drying gas conduit 11 leading to the tube-mill 8. The system may be provided with a separate injection ventilator 16' which makes it possible to regulate the quantity of injection gas for the burner in accordance with the quantity of coal dust to be ejected. Also, when the resistance to injection of the coal dust is very high, the use of a separate injection ventilator 16' for independent operation of the grinding system may be advantageous.

The gravel separated out of the sifter 6 is delivered by a gravel chute 18 into an intermediate container 19. The latter includes two outlet openings 20 and 20' to which are attached two worm feed conveyors 22 and 22' which are utilized as metering conveyors. The worm conveyor 22' supplies a predetermined fraction, A of the gravel to the tube mill 8, while the other fraction, B, is supplied through the worm feed conveyor 22 to the breaker-hammer mill 2. The speeds of the two worm feed conveyors 22 and 22' can be independently adjusted to proportion the relative amounts of the particulate material going to the tube mill 8 and the breaker-hammer mill 2, respectively.

Figure 3:
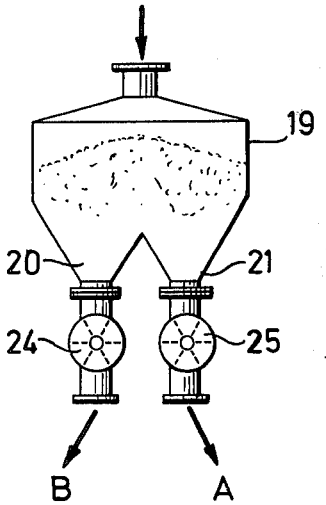
FIG. 3 is a view partially in elevation and partially in cross-section illustrating one form of metering device which can be used.

FIG. 3 illustrates a gravel receiving container 19 with two outputs 20 and 21 underneath which there are two bucket wheel charging valves 24 and 25 which operate as metering devices. The two valves provide the gravel into fractions A and B with a predetermined ratio of volume with respect to one another, dependent upon their relative rotation rates.

Figure 4:
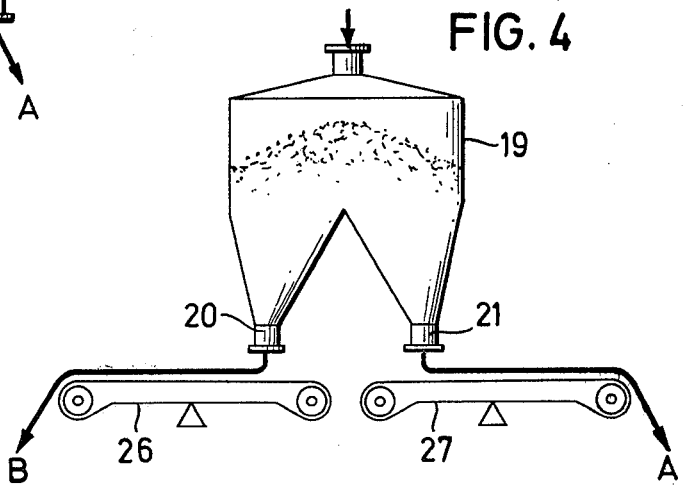
FIG. 4 illustrates rather diagrammatically another form of metering device which can be used.

FIG. 4 illustrates a gravel container 19 having two outlets 20 and 21. Underneath these outlets are arranged two conveyor scales 26 and 27 which divide the gravel into fractions A and B as illustrated.

Figure 5:
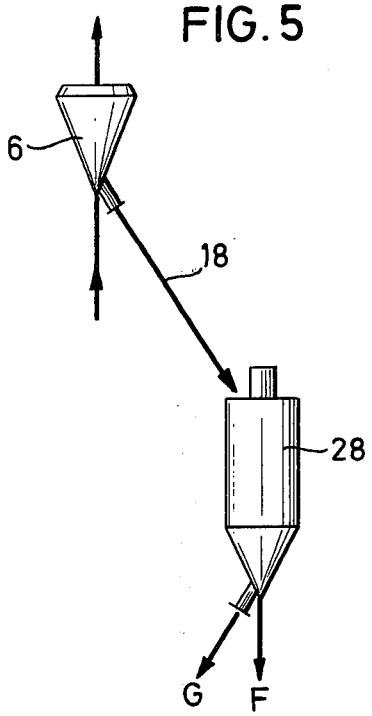
FIG 5 is a partial view of another apparatus which can be used for metering according to the present invention.

FIG. 5 shows an arrangement for the division of gravel into fractions according to grain size by the use of a dynamically operating sifter 28 to which the gravels are supplied from the sifter 6 through a gravel chute 18. The dynamic sifter 28 separates the gravel into a finer fraction F and a coarser fraction G.

Figure 6:
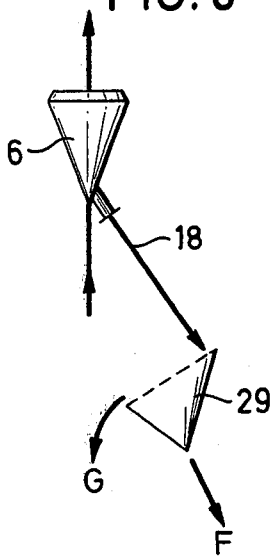
FIG. 6 illustrates a sifting machine which can be used for classifying gravel according to the present invention.

Likewise, a division of gravel according to grain size is accomplished in the apparatus shown in FIG. 6. Here, instead of the coarse sifter, a sifting machine 29 is used. The latter classifies the gravel arriving through the gravel chute 18 according to grain size, the coarse material G constituting the overflow, and the fine material F constituting the through-put of the sifting machine.

When using the sifting machines which provide a definite separation of gravel according to particle size, the coarser particle gravels for example, having an average size above 2 or 3 mm are returned to the breaker-hammer mill 2 while the finer gravels having an average particle size below about 2 or 3 mm are conveyed into the tube mill 8. This separation is very advantageous in the case of coal dust containing portions of sand or pyrites because the latter which are mainly finely divided particles would increase the wear in the breaker-hammer mill substantially if those gravel portions were directed into that mill.

Figure 7:
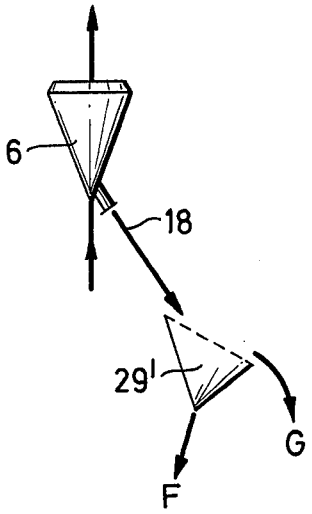
FIG. 7 illustrates a modified arrangement of the sifting machine shown in FIG. 6.

On the other hand, it may occur that with certain substances, the coarser constituents of the gravel are more poorly grindable than the finer constituents as occurs, for example, with raw material to be used in the manufacture of cement. In such case, it is more advantageous for reasons of wear to convey the coarser constituents of the gravel into the tube mill and the finer gravel into the breaker or impact hammer mill. This can be accomplished according to an apparatus diagrammatically illustrated in FIG. 7 which utilizes a sieve 29' in the gravel return flow to produce a fine fraction F and a coarse fraction G.

From the foregoing it will be appreciated that the present invention provides a new and improved method of and apparatus for grinding of particulate material wherein coarse grinding and fine grinding are involved and wherein coarse residue from a sifter is delivered to a metering device from which the coarser particles from the metering device are selectively metered to the coarse grinding device and to the fine grinding device selectively and substantially proportionately in accordance with loads in the grinding devices, thereby maintaining efficient load and grinding capacity relationship in the grinding devices.

It will be understood that various modifications can be made to the described embodiments without departing from the scope of the present invention.

We claim as our invention:

1. A method of grinding particulate material which comprises:

introducing the material to be ground into a coarse grinding device, delivering the ground product from said coarse grinding device into a sifter and separating coarse residue from the ground product, delivering the coarse residue from the sifter to a metering device, selectively passing metered fractions of the coarse residue from said metering device into said coarse grinding device and into a fine grinding device, and selectively metering the coarse residue from said metering device to said coarse grinding device and said fine grinding device selectively and substantially proportionately in accordance with loads in said grinding devices and thereby maintaining efficient load and grinding capacity relationship in said grinding devices.

2. A method according to claim 1 in which said particulate material is coal.

3. A drying-grinding apparatus comprising:

an enclosed coarse grinding means having an inlet and an outlet and arranged to produce a relatively coarse ground product;

a second grinding means having an inlet and an outlet arranged to produce a relatively fine ground product;

said inlet of said first grinding means having a gas-tight charging valve for solids as well as an inlet for the introduction of a hot drying gas;

said outlet of said first grinding means having a feed pipe; an air current separator connected to said feed pipe;

separating means receiving the coarser particles from said air current separator, said separating means having two material outlets;

means connecting one of said material outlets to said inlet of said first grinding means;

means connecting the other of said material outlets to the inlet of said second grinding means;

means for introducing a hot drying gas into the inlet of said second grinding means;

a cyclone separator receiving the finer fraction of particles from said air current separator;

and means for metering the coarser particles from said separating means into said two material outlets selectively substantially proportionately in accordance with loads in said grinding means so as to maintain an efficient load and grinding capacity relationship in the operation of said grinding means.

4. An apparatus according to claim 3 in which: said separating means includes two adjustable speed worm feed conveyors.

5. An apparatus according to claim 3 in which: said metering means includes two bucket wheel charging devices having adjustable rotation rates.

6. An apparatus according to claim 3 in which: said metering means has a rocker device for proportioning the amount of material sent to said first grinding means and said second grinding means, respectively.

7. An apparatus according to claim 6 in which: said metering means includes a conveyor scale.

8. An apparatus according to claim 6 in which: said metering means includes a sifting machine.

* * * * *